US008714308B2

(12) United States Patent
Schlipper

(10) Patent No.: US 8,714,308 B2
(45) Date of Patent: May 6, 2014

(54) FALL ARREST SAFETY NET

(75) Inventor: Robert Wesley Schlipper, Hong Kong (HK)

(73) Assignee: MRM HK Limited, Hong Kong (HK)

( * ) Notice: Subject to any disclaimer, the term of this patent is extended or adjusted under 35 U.S.C. 154(b) by 587 days.

(21) Appl. No.: 12/460,245

(22) Filed: Jul. 16, 2009

(65) Prior Publication Data

US 2011/0011677 A1 Jan. 20, 2011

(51) Int. Cl.
*A44B 99/00* (2010.01)

(52) U.S. Cl.
USPC ..... 182/230; 182/137; 182/138; 24/115 R; 24/129 R; 24/130; 24/129 B

(58) Field of Classification Search
USPC ..... 182/137, 138; 24/129 R, 130, 129 B, 24/115 R, 128
See application file for complete search history.

(56) References Cited

U.S. PATENT DOCUMENTS

| | | | | | |
|---|---|---|---|---|---|
| 107,952 | A | * | 10/1870 | Osborn | 24/130 |
| 363,495 | A | * | 5/1887 | Wilson | 24/130 |
| 656,431 | A | * | 8/1900 | Stewart | 24/130 |
| 790,929 | A | * | 5/1905 | Smith | 294/74 |
| 866,965 | A | * | 9/1907 | Redding | 70/65 |
| 1,201,972 | A | * | 10/1916 | Keely | 24/132 R |
| 1,426,537 | A | * | 8/1922 | Bauer | 24/130 |
| 1,491,316 | A | * | 4/1924 | Ryan | 40/647 |
| 1,541,427 | A | * | 6/1925 | Low | 24/30.5 R |
| 1,546,798 | A | * | 7/1925 | Seagren | 24/129 B |
| 1,570,291 | A | * | 1/1926 | Van Alstine | 242/388.4 |
| 2,233,083 | A | * | 2/1941 | MacKenzie | 294/74 |
| 2,240,510 | A | * | 5/1941 | Meighan | 294/74 |
| 2,316,950 | A | * | 4/1943 | Goeller | 211/119.15 |
| 2,440,712 | A | * | 5/1948 | Bickell | 294/77 |
| 2,991,539 | A | * | 7/1961 | Higgins | 294/77 |
| 3,328,064 | A | * | 6/1967 | Simon | 292/288 |
| 3,930,288 | A | * | 1/1976 | Black et al. | 24/129 R |
| 3,953,911 | A | * | 5/1976 | Fishack | 24/16 R |
| 4,066,144 | A | * | 1/1978 | Valerio, Jr. | 182/140 |
| 4,107,825 | A | * | 8/1978 | Brawand | 24/115 R |
| 4,280,435 | A | * | 7/1981 | Loomis | 114/219 |
| 4,723,634 | A | * | 2/1988 | Fisk | 188/65.4 |
| 4,982,813 | A | * | 1/1991 | Starr | 182/138 |
| 5,167,299 | A | * | 12/1992 | Nusbaum | 182/138 |
| 5,351,367 | A | * | 10/1994 | Kennedy et al. | 24/129 R |

(Continued)

OTHER PUBLICATIONS

U.S. Appl. No. 09/063,682, filed Feb. 22, 2000, MRM Holdings LTD.

*Primary Examiner* — Katherine Mitchell
*Assistant Examiner* — Colleen M Chavchavadze
(74) *Attorney, Agent, or Firm* — Faegre Baker Daniels LLP

(57) ABSTRACT

A fall arrest safety net assembly has the form of a bag constructed of wire mesh, with a closed end and an opposing open mouth about which a plurality of eyes are spaced. An elongate line has opposing first and second ends, first and second line portions of the line being disposed adjacent the first and second ends respectively, an intermediate portion of the line located between the first and second line portions. A choker fitting has two faces between which a plurality of openings extend, and an end fixture on the choker fitting. The first portion of the line is connected in a ring by the choker fitting, the first end being fixed to the end fixture, the first portion extending through the eyes for drawing the mouth closed, and the intermediate portion extending through the openings in the choker fitting.

15 Claims, 8 Drawing Sheets

(56) References Cited

U.S. PATENT DOCUMENTS

| | | | | | |
|---|---|---|---|---|---|
| 5,839,768 | A * | 11/1998 | Wackerly | 294/74 |
| 6,026,662 | A * | 2/2000 | Schlipper | 70/18 |
| 6,077,587 | A * | 6/2000 | Potok | 428/99 |
| 6,112,379 | A * | 9/2000 | Fernandez | 24/712.1 |
| 6,244,081 | B1 * | 6/2001 | Schlipper | 70/18 |
| 6,317,935 | B1 * | 11/2001 | O'Rouke | 24/129 R |
| 6,389,655 | B2 * | 5/2002 | Libecco | 24/300 |
| 7,069,753 | B2 * | 7/2006 | Schlipper | 70/18 |

* cited by examiner

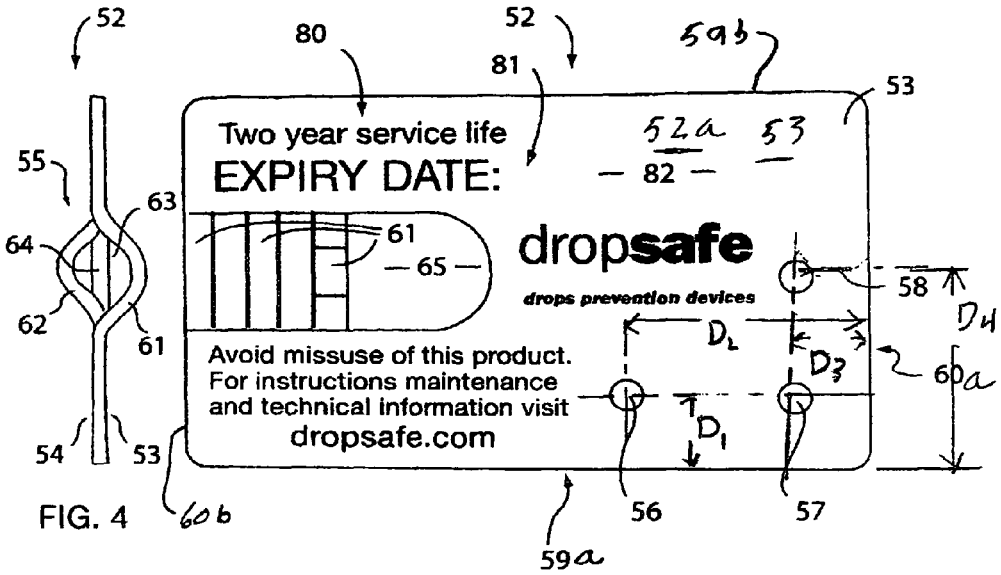
FIG. 4
FIG. 5
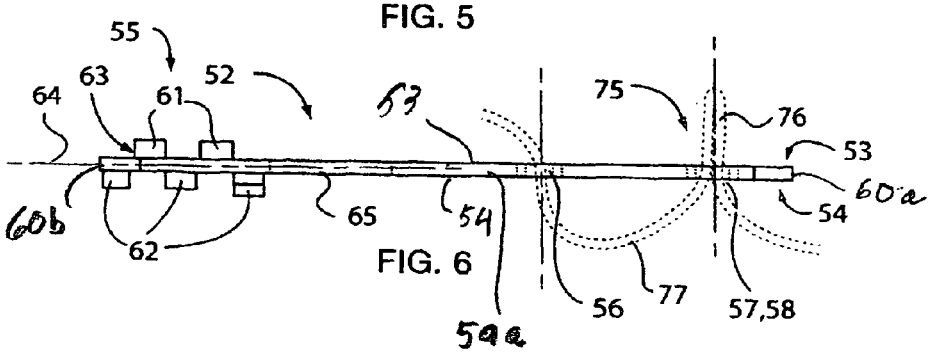
FIG. 6

FALL ARREST SAFETY NET

TECHNICAL FIELD

The present invention relates to a safety net having an attachment device for securing to a construction element particularly for use as a fall arrest apparatus.

BACKGROUND OF THE INVENTION

When working at elevated positions, in order to protect anyone below the working position, a safety apparatus should be provided to arrest a fall of debris. Typically a safety net may be suspended just below the working height fastened, for example, to free standing columns or to fixtures mounted to a wall.

However for permanent fall arrest protection, for instance in engineering facilities having overhead fittings, maintaining a suspended safety net to span the entire overhead area may not be appropriate due to the construction of the facility, the working height, the obstruction it would cause or its cost. There is therefore a need for an improved safety apparatus which addresses these drawbacks, is relatively inexpensive to manufacture and easy to install. It is an object of the present invention to address this need or, more generally, to provide an improved safety net.

DISCLOSURE OF THE INVENTION

According to one aspect of the present invention there is provided a safety net assembly comprising: a bag constructed of wire mesh, the bag having an open mouth, the bag including a plurality of eyes integral with the wire mesh and spaced circumferentially about the mouth;

an elongate line having opposing first and second ends, first and second line portions of the line being disposed adjacent the first and second ends respectively, an intermediate portion of the line located between the first and second line portions, and a choker fitting having two faces between which a plurality of openings extend, and an end fixture on the choker fitting, wherein the first portion of the line is connected in a ring by the choker fitting, the first end being fixed to the end fixture, the first portion extending through the eyes for drawing the mouth closed, and the intermediate portion extending through at least one of the openings in the choker fitting.

The first portion of the line provides an elongate flexible member, and while the first portion of the line may be continuous, it may alternatively be interrupted by fasteners, links, or the like, connected to adjacent ends of the line and which can be separated so that the ring may be broken as needed in some installations of the net (which are discussed below).

Preferably the intermediate portion extends through the openings in the choker fitting so that a loop in the line protrudes from each of the faces of the choker fitting. It will be apparent that two openings will be sufficient for connection in this manner, however most preferably the openings include three openings through which the line passes sequentially.

Preferably the line further comprises a terminal eye formed on the second end of the line. The assembly preferably further comprises a hook fastener received in the terminal eye.

Preferably the two faces of the choker fitting comprise opposing faces of a planar part of the choker fitting, the end fixture comprising a line-receiving aperture having an axis disposed in the plane of the planar part and the first end of the line includes a fixture thereon, whereby the first portion is received in the line-receiving aperture and the fixture is sized so as not to pass through the line-receiving aperture.

Preferably the wire mesh bag is formed from a length of wire with fastenings joining portions of the length of wire, the length of wire extending from the closed end toward the mouth and being turned back upon itself to form the eyes at the mouth and corresponding eyes at the closed end, each eye at the mouth being fixed by a respective one of said fastenings to the adjacent eye on either side thereof, and each eye at the closed end being fixed by a respective one of said fastenings to the adjacent eye on either side thereof to form the bag.

The fastenings that join two portions of the length of wire and are preferably all of like type, most preferably being ferrules which are crimped or moulded in place.

Preferably the fastenings joining the eyes at the closed end are more closely spaced along the length of wire than the fastenings joining the eyes at the mouth.

In another aspect the invention provides a method of securing apparatus mounted overhead upon a construction member, the method comprising:

providing a safety net assembly substantially as described above;

introducing the apparatus through the mouth so as to at least partially enclose the apparatus in the wire mesh bag;

manipulating the choker fitting and line to close the mouth;

looping the second portion about the construction member, and connecting the first portion and the second end by means of a hook fastener.

This invention provides a safety net assembly which is effective and efficient in operational use, and which has an overall simple design which minimizes manufacturing costs and maximizes performance.

BRIEF DESCRIPTION OF THE DRAWINGS

Preferred forms of the present invention will now be described by way of example with reference to the accompanying drawings, wherein:

FIG. 1 is formed;

FIGS. 4, 5 and 6 are orthogonal end, front and side views respectively of the choker fitting of the safety net assembly of FIG. 1;

DESCRIPTION OF THE PREFERRED EMBODIMENTS

Figure 1:
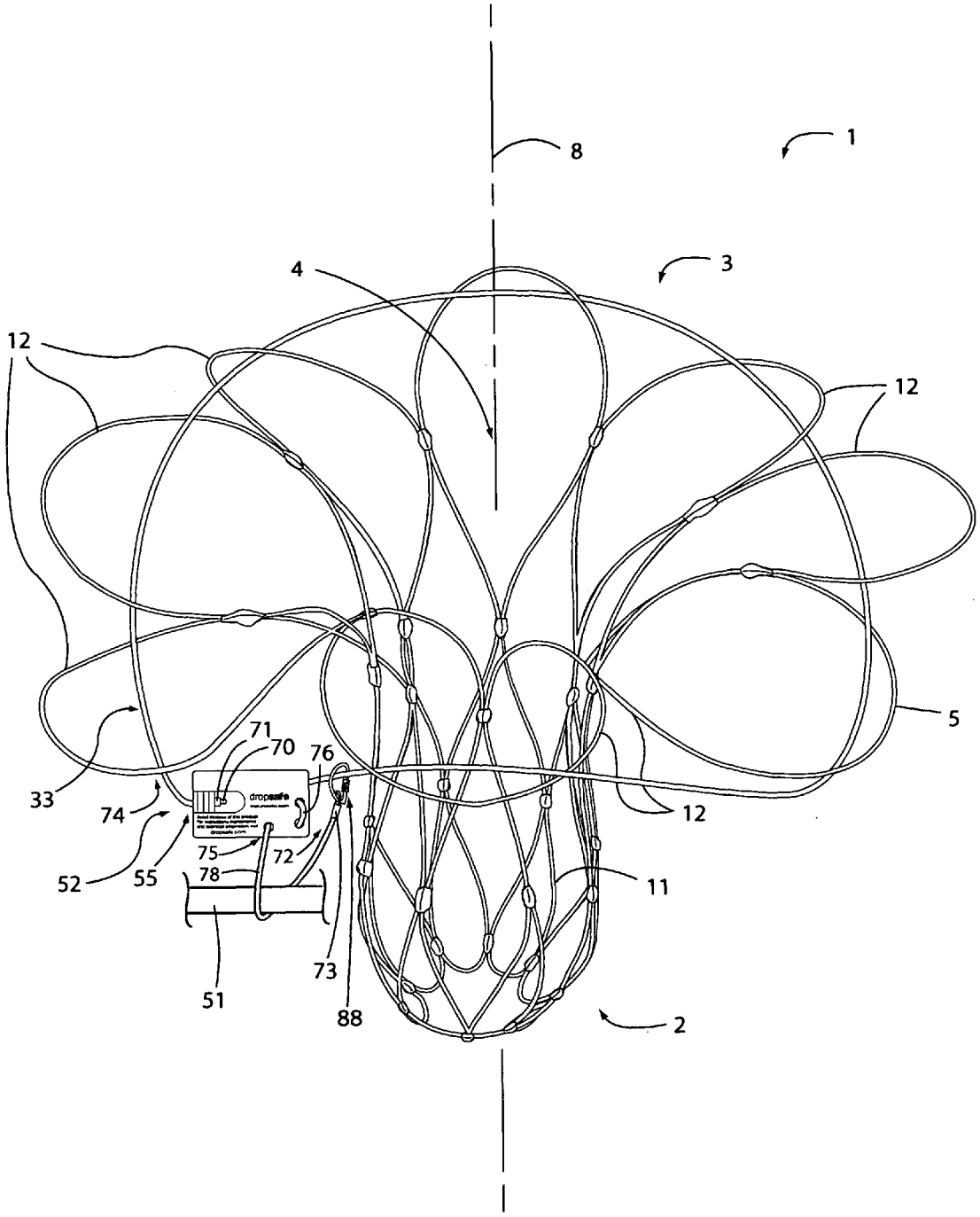
FIG. 1 is pictorial view of a first exemplary embodiment of the safety net assembly of the invention in a collapsed state ready to receive an item of value.
Figure 2:
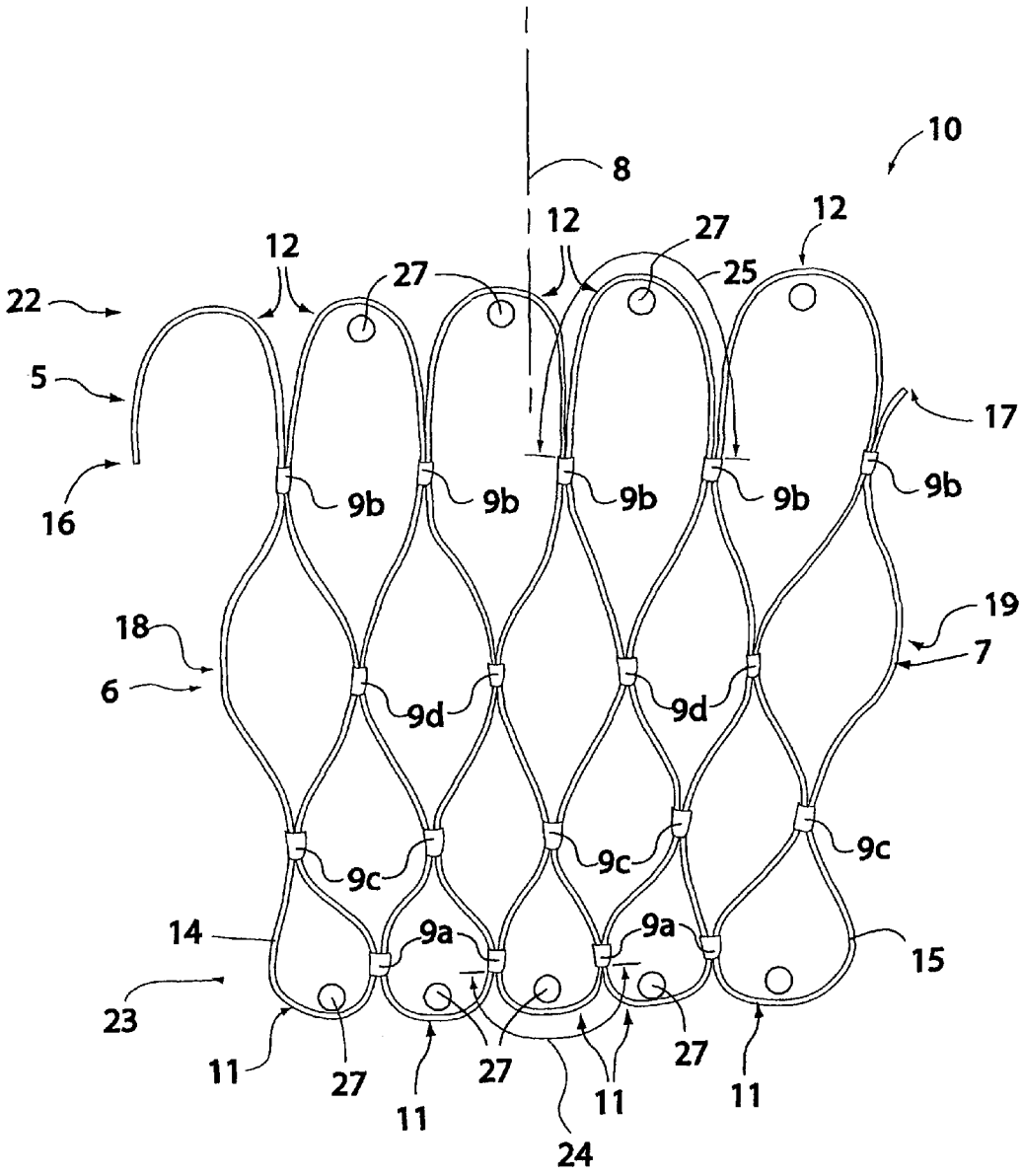
FIG. 2 is a plan view of a web of mesh from which the safety net assembly

Referring to FIGS. 1 and 2 of the drawings, a first embodiment of a safety net assembly includes a bag 1 having a narrow closed end 2 and a broader opposing open mouth 3 in which an opening 4 is provided for receiving an apparatus to be secured, such as a light fitting 50 (shown in FIG. 7) mounted overhead on a construction member such as a beam 51. A line 33 passes in a ring through the eyes 12 of the mouth 3 and cooperates with a choker fitting 52 to draw together the eyes 12 to close the opening 4. An end of the line 33 is looped around the beam 51 to secure the assembly in place.

In the first embodiment illustrated the mesh is made from a length of wire 5 which may be continuous (i.e. a single length) or discontinuous (for instance, including end-to-end joints) and which provides a degree of flexibility and resilience to the bag 1, allowing it to be expanded in the transverse direction to accommodate apparatus of varying size, while being readily collapsible. The bag 1 is made from a planar mesh 10, shown in FIG. 2, which is curved or folded about a longitudinal axis 8; the transversely opposing edges 6, 7 of the mesh 10 are then joined to produce the substantially tapered bag-like form (shown in FIG. 1 in its collapsed or relaxed state).

The mesh 10 is a non-woven type in which portions of the length of wire 5 are joined by fastenings in the form of ferrules 9*a*, 9*b*, 9*c*, 9*d* at nodes of the mesh. The length of wire 5 extends generally longitudinally and is turned back upon itself and joined by ferrules 9*c* to form eyes 11 at the first edge 23 of the mesh 10, and by ferrules 9*d* to form eyes 12 at the longitudinally opposing second edge 22 of the mesh 10. Fastenings in the form of ferrules 9*b* join the adjacent eyes 12 along the second edge 22 and ferrules 9*a* join the adjacent eyes 11 along the along the first edge 23.

The mesh 10 may be conveniently manufactured by winding the length of wire 5 between pegs 27 spaced apart in two parallel lines, the lines being spaced apart in the longitudinal direction (relative to the mesh 10). The length of wire 5 is wound about the pegs in a zigzag pattern, alternating in direction when it is turned back upon itself around each peg 27.

Figure 3:
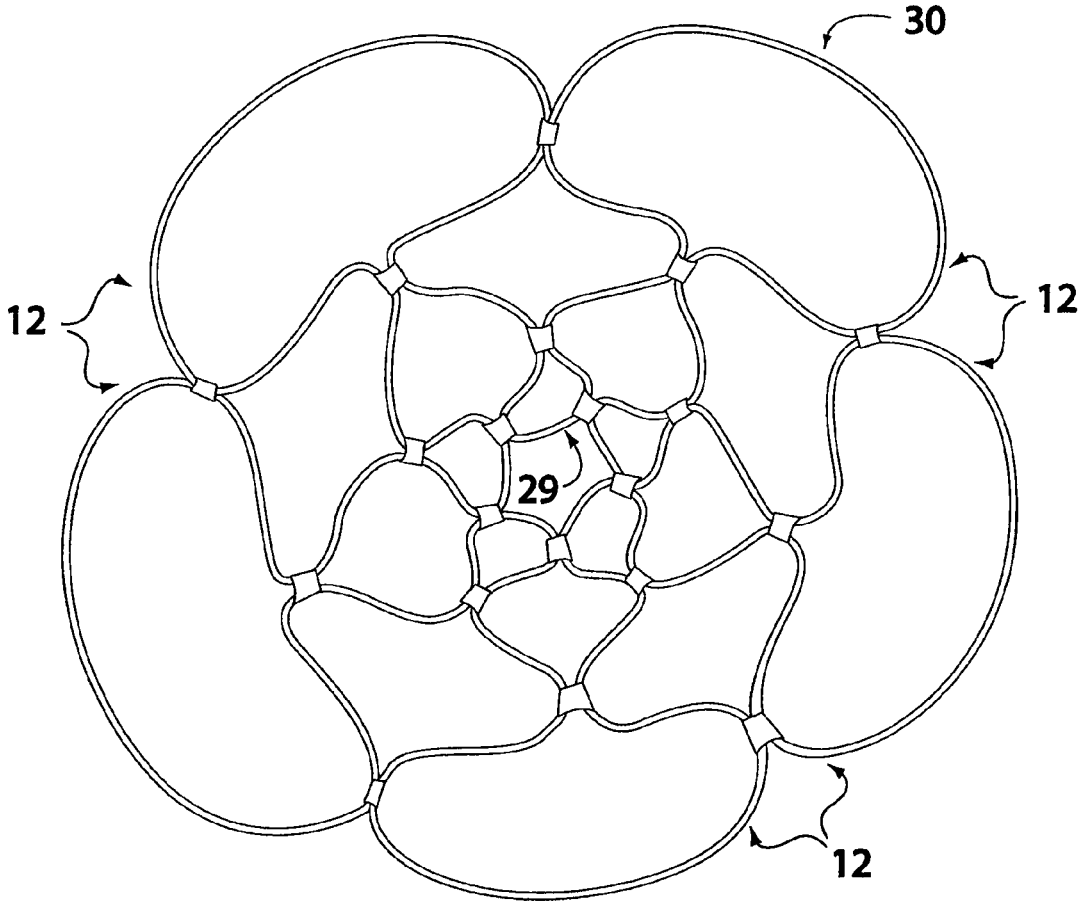
FIG. 3 is a plan view of the safety net assembly of FIG. 1.

To then form the bag 1 from the mesh 10 of FIG. 2, the mesh 10 is removed from the pegs 27 curved about the longitudinal axis 8. Portions 14 and 15 of the outermost first edge eyes 11 are then joined by a ferrule (not shown) such that each eye 11 is fixed by a ferrule to the adjacent eye on either side thereof. In like manner the ends 16, 17 of the length of wire 5 are joined by a ferrule (not shown) such that each eye 12 along the second edge 22 is fixed by a ferrule to the adjacent eye on either side thereof. In addition a further ferrule (not shown) joins portions 18 and 19 on opposing transverse edges of the mesh 10 to form the substantially axisymmetrical bag 1. As best seen in FIG. 3, all the eyes 11 are joined in a first ring 29 to form a closed end of the bag 1. All the eyes 12 are joined in a second ring 30 which forms the opening 4.

To produce a bag 1 shaped to taper outwardly from the closed end 2 toward the open mouth 3, the transverse dimension of the second edge 22 exceeds that of the first edge 23. To achieve this, the eyes 12 are larger than the eyes 11 and the ferrules 9*a* joining the eyes 11 are spaced more closely apart (by dimension 24 measured along the length of wire 5) than the ferrules 9*b* joining the eyes 12 on the second edge 22 (which are spaced by dimension 25 measured along the length of wire 5).

The choker fitting 52 shown in detail in FIGS. 4-6, is formed from a substantially rectangular stainless steel sheet having opposing faces 53, 54. On one side of the choker fitting 52 is an end fixture 55, while on the opposite side are three circular openings 56, 57, 58 sized to receive the line 33. The opening 57 is proximate a corner of the sheet, with the openings 56, 58 spaced at the same radial distance from opening 57 and at the same distance from their respective orthogonal edges 59, 60. Formed in the choker fitting 52, as by a slitting/pressing operation, the end fixture 55 includes integral U-shaped arms 61, 62 projecting either side from faces 53, 54 and thereby spanning and defining a line-receiving aperture 63 having an axis 64 disposed in the plane of the planar member. Adjacent the innermost arm 62 is a through-extending aperture 65 which is substantially D-shaped. On the front face 53 are textual indicia 80 including an "Expiry date" marking 81 located adjacent a blank area 82 where a date can be permanently marked, by engraving, etching, stamping of the like, to notify users of the end of the working life of the product.

As shown most clearly on FIGS. 4, 5 and 6, the choker fitting 52 has an upper surface 54 and a lower surface 53, a first pair of spaced apart opposed edge surfaces 59*a* and 59*b* and a second pair of spaced apart edge surfaces 60*a* and 60*b* which extend between the first pair of edge surfaces 59*a* and 59*b*. The edge surfaces 59*a*, 59*b* 60*a* and 60*b* define a surface region 52*a* of the choker surfaces 53 and 54 enclosed therebetween.

The choker fitting 52 has a first plurality of apertures 56, 57 and 58 extending between the upper surface 53 and the lower surface 54 in the region 52*a*. The aperture 56 is spaced by a first distance D1 from the edge surface 59*a* and a second distance D2 from the first of the second side edge 60*a*. The second aperture 57 is aligned with the first aperture 56 and is spaced the first distance D1 from the first side edge 59*a* and is spaced a third distance D3 from the side edge 60*a*. the third aperture 58 is aligned with the second aperture 57 and is spaced the third distance D3 from the side edge 60*a* and a fourth distance D4 fro the side edge 59*a*. As shown on FIG. 5, the three apertures 56, 57 and 58 are in a generally "L" shaped array in the preferred embodiment of the present invention. However, different arrays of the apertures may be selected as desired for particular applications.

The end fixture aperture 65 is spaced from the three apertures 56, 57 and 58 near the side edge 6*b* approximately equally distanced from the side edges 59*a* and 59*b*. However a different location for the end fixture aperture 65 may be selected as desired for particular applications.

The line 33 has a first end 70 adjacent to which a bead-shaped ferrule or fixture 71 is fixed. The fixture 71 is disposed in the aperture 65 while the first end 70 extends through the line-receiving aperture 63, the fixture being larger than the aperture 63 so as to thereby fix the first end the choker fitting 52. A second end 72 of the line 33 opposing the first end 70 includes a terminal eye 73 formed as by an eye splice or by a loop fixed by a ferrule, or like fastener.

A first portion 74 of the line 33 adjacent the first end 70 extends from the end fixture 55 in a ring through the eyes 12 for drawing the mouth 3 closed. A second portion 78 of the line 33 extends from the choker fitting 52 to the second end 72.

An intermediate portion 75 of the line 33 is located between the first and second line portions 74, 78, and passes sequentially through the openings 56, 57, 58 in the choker fitting. As shown in dashed outline in FIG. 6, a first loop 76 of the line extends through the openings 57, 58 to protrude from of the face 53, while a second like loop 77 extending between openings 56 and 57 protrudes from the face 54.

The line 3 and the length of wire 5 are preferably twisted stainless steel wire cables for corrosion resistance. Similarly the other components, such as the ferrules 9*a*, 9*b*, 9*c*, 9*d* and the hook fastener are also formed of stainless steel.

Figure 7:
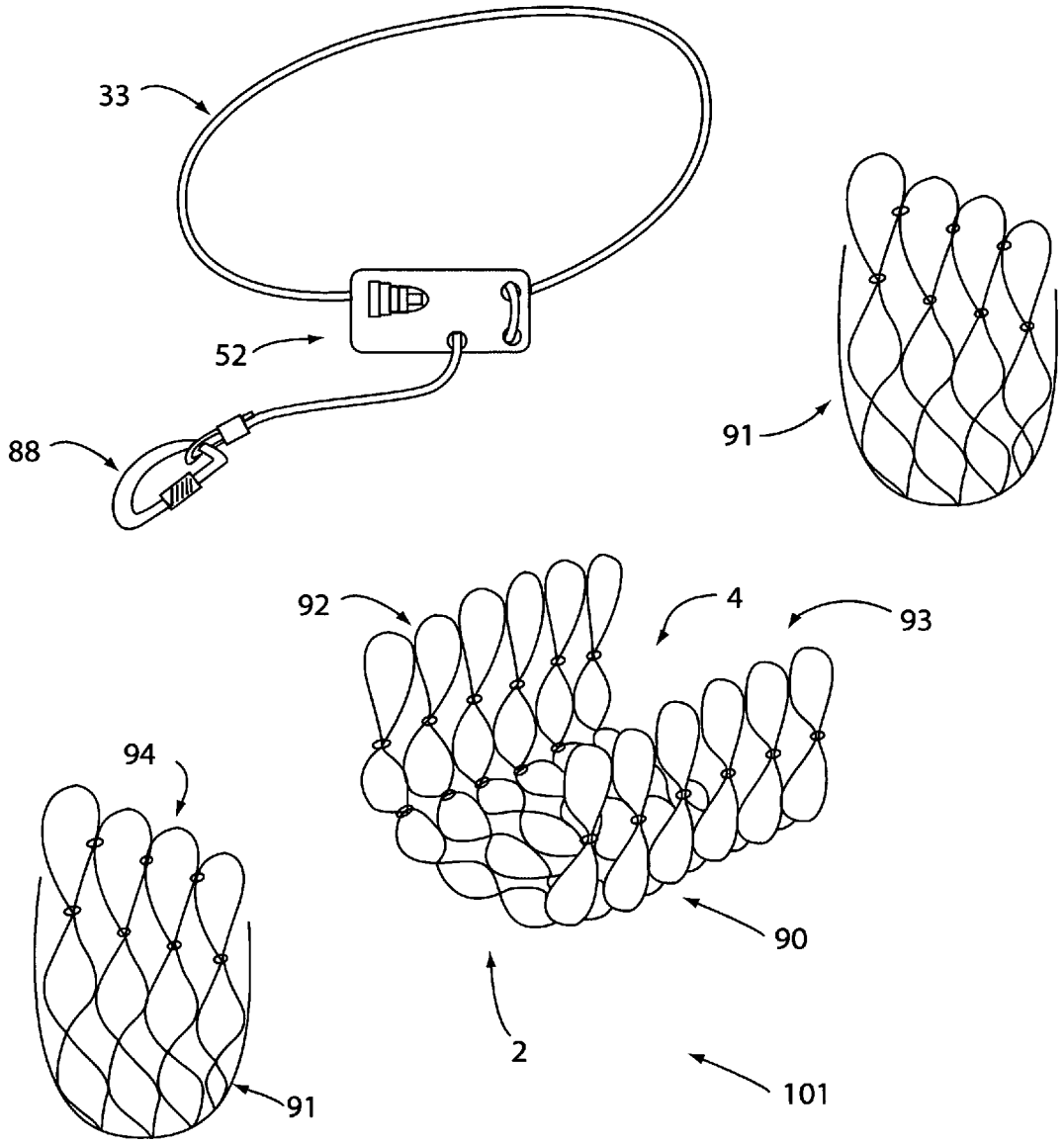
FIG. 7 is an exploded pictorial view of a second exemplary embodiment of the safety net assembly of the invention.

FIG. 7 shows an exploded view of a second embodiment of the safety net assembly employing the line 33 and choker 52 of the first embodiment, but wherein the bag 101 is assembled from a folded main panel 90 and two like end panels 91. The panels 90, 91 are each formed of a flexible wire mesh, and may each be formed initially as a planar mesh from a single length of wire joined at nodes of the mesh by ferrules, or moulded beads etc. The main panel 90 is a rectangular panel folded in a curve and includes rows of eyes 92, 93 along longitudinally opposite transverse edges which, when the panel 90 is folded in a curve as shown are brought together to form opposing sides of the mouth 4, the curved central section of panel 90 forming the closed end 2. The panels 91 have a row of eyes 94 along one edge and are shaped with an arcuate opposing edge complementary to the form of the panel 90. Each end panels 90 is fixed about its peripheral edge, as by ferules or the like, to a long edge of the panel 91, such that the rows of eyes 92, 93, 94 are generally coplanar, the eyes being spaced about the periphery of the mouth 4. In like manner to the first embodiment, the line 33 passes from the choker fitting 52 through the eyes 92, 93, 94 and back to the choker fitting 52, for drawing the mouth 3 of the bag 101 closed.

Figure 8:
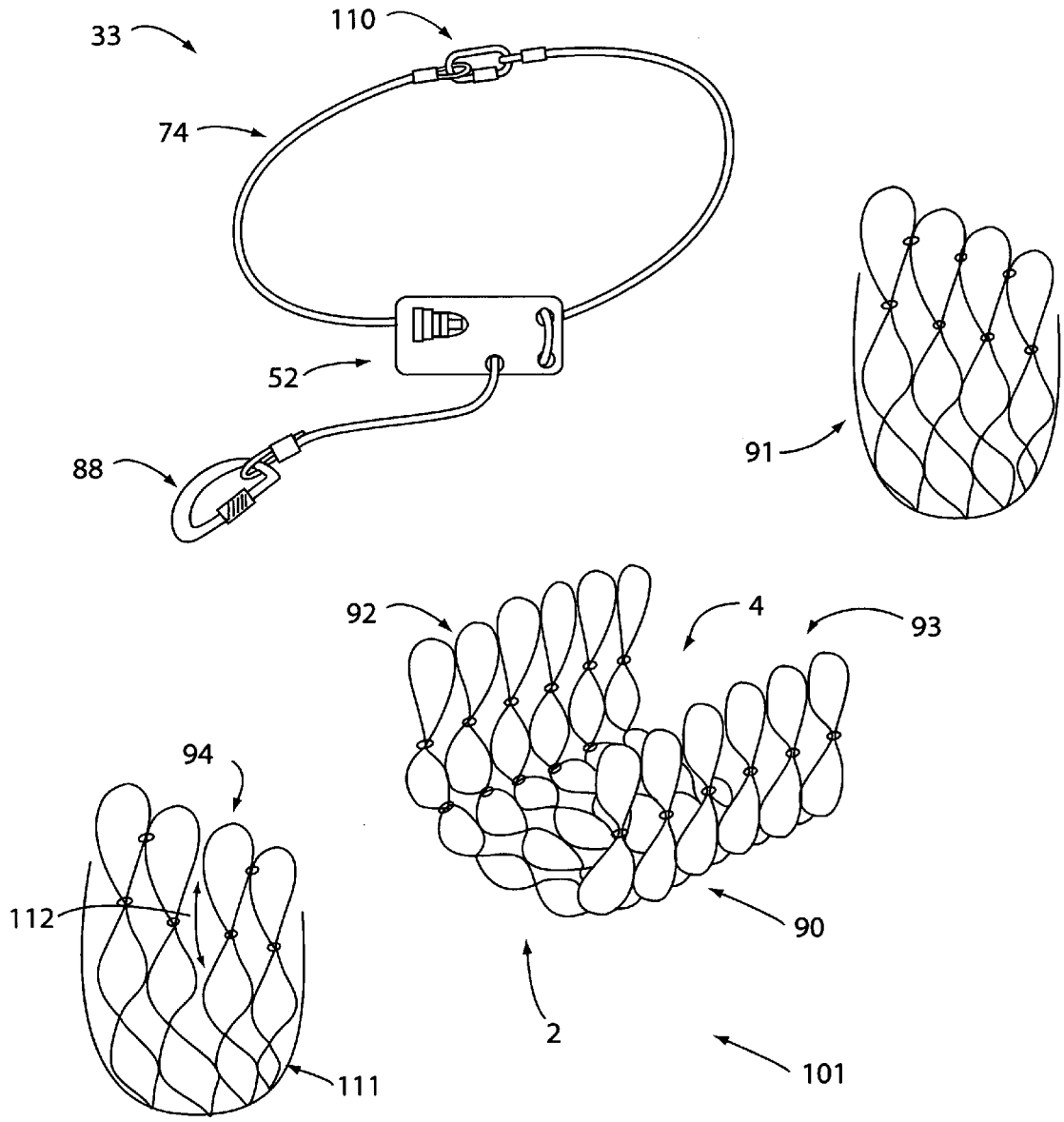
FIG. 8 is an exploded pictorial view of a third exemplary embodiment of the safety net assembly of the invention.

A third embodiment of the invention is shown in FIG. 8 and includes panels 90, 91, 111 each formed from a flexible wire mesh. The panels 111, like the panels 91 the second embodiment, have a row of eyes 94 along one edge and are shaped with an arcuate opposing edge complementary to the form of the panel 90. The panel 111 further includes a slit 112 in the fabric of the mesh (where adjacent wire loops are disconnected). The slit 112 extends longitudinally down from the row of eyes 94 to an intermediate position in the panel. The end panel 111 is otherwise of like construction to the panels 91 and is fixed about its peripheral edge to a long edge of the panel 91, in like manner to the second embodiment. The ring-shaped first portion 74 has a fastener 110 connected in the line 33, allowing the ring to be opened and closed. As shown, the fastener 110 may be a carabiner joining permanent eyes formed in the first portion.

Figure 9:
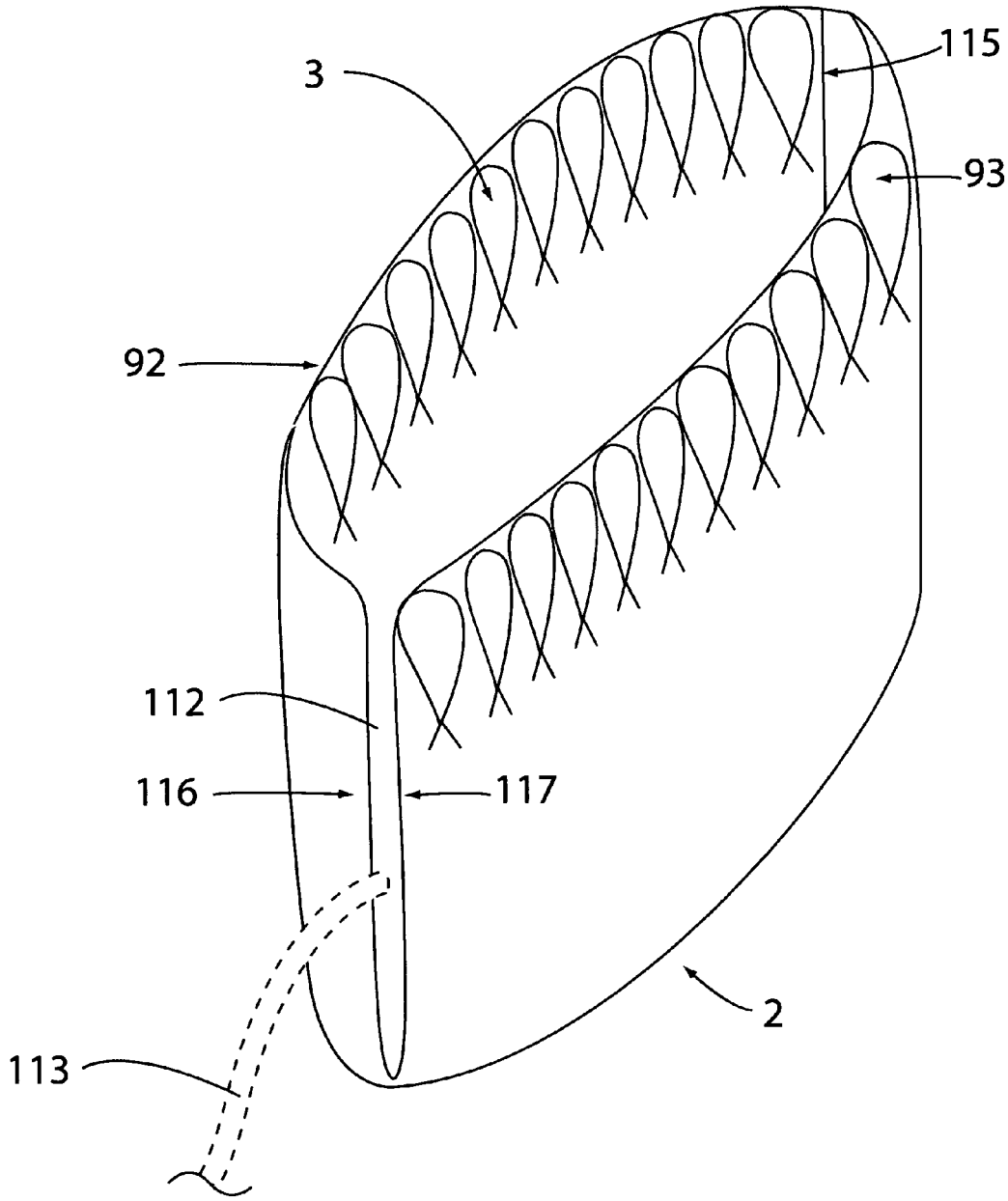
FIG. 9 is schematic pictorial view of a fourth exemplary embodiment of the safety net of the invention.

In a fourth embodiment the net of the invention, shown in FIG. 9, is formed from a single generally rectangular panel of flexible wire mesh. Like the second and third embodiments, a folded central part of the panel forms the closed end 2 and the opposing short edges of the panel bound the periphery of the open mouth 3, the line 33 passing from the choker fitting 52 through the eyes 92, 93 and back to the choker fitting 52, for drawing the mouth 3 closed. The two halves of the long edge on one side of the panel are connected by join line 115. The two halves 116, 117 of the opposing long edge of the panel are not joined, and define a slit 112 extending from the mouth 3 down one side of the bag toward the closed end 2, in like manner to the third embodiment of FIG. 8.

Figure 10:
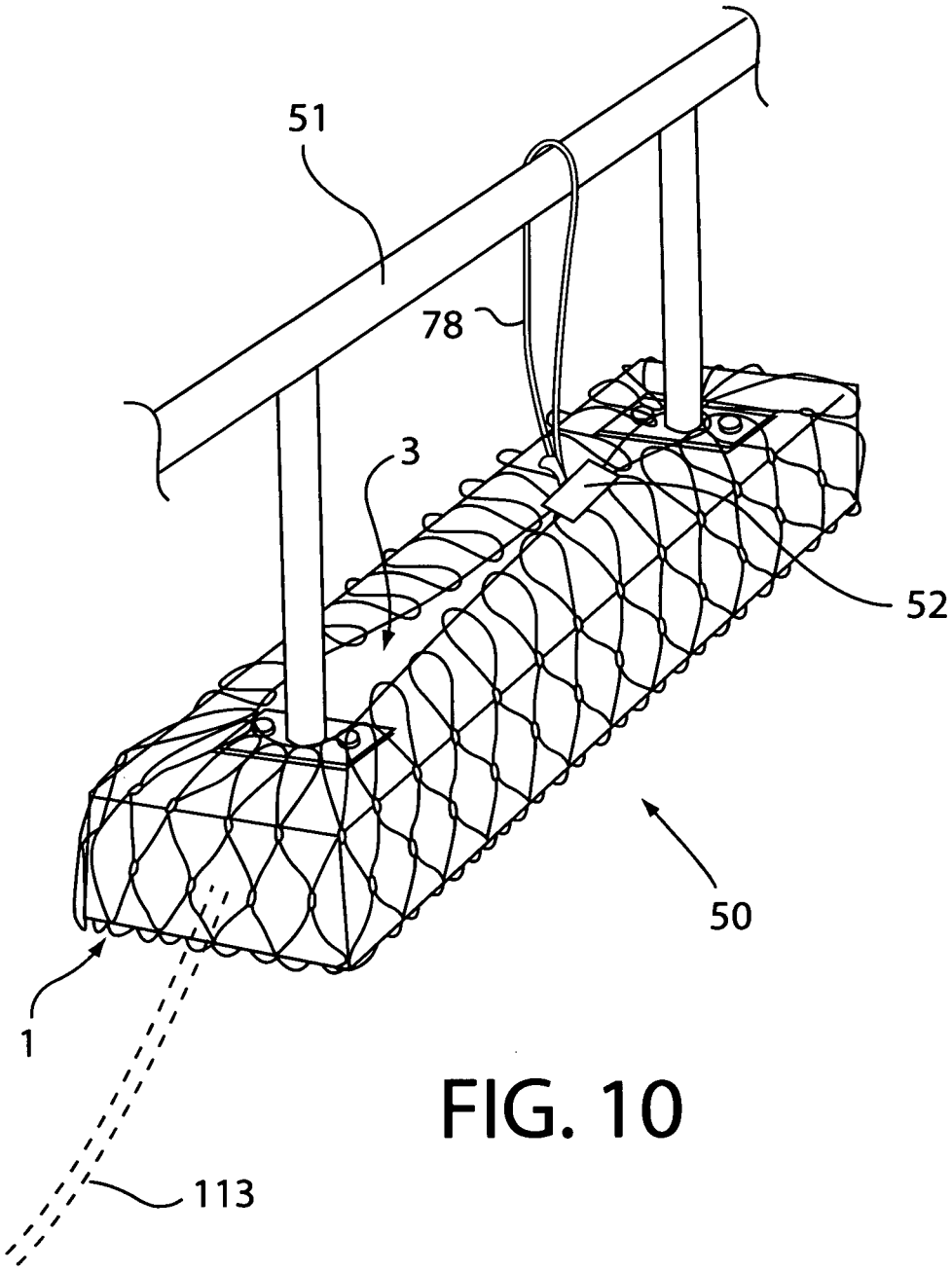
FIG. 10 is a perspective view of an alternative embodiment of the safety net assembly of the invention installed in use.

In use, as best seen in FIG. 10, the components of the light fitting 50 are first introduced through the open mouth 3 thereby substantially enclosing the light fitting in the bag 1. By then manipulating the choker fitting to draw the line through the openings 56, 57, 58 the ring-shaped first line portion 74 is reduced in size to close the mouth 3. The second portion 78 of the line 33 is then looped about the construction member 51. A hook fastener 88 (such as a carabiner having a hinged gate and screw closure) is inserted through the terminal eye 73 and through the ring-shaped first line portion 74 to secure the assembly. When the third embodiment is used a member 113 (such as the power cable shown in phantom in FIGS. 9 and 10) which protrudes through the bag may be received in the split 112, while still closing the mouth 3. The fastener 110 is positioned proximate the slit 112 and opened to break open the ring and allow entry of the member 113 into the slit 112. By reconnecting the fastener 110, the mouth can then be drawn closed, to the same degree as the second embodiment, substantially enclosing the light fitting 50.

Aspects of the present invention have been described by way of example only and it should be appreciated that modifications and additions may be made thereto without departing from the scope thereof.

The invention claimed is:

1. A fall arrest safety net assembly for securing an overhead filling connected to an electrical cable, said assembly comprising: a bag constructed of wire mesh, the bag having an open mouth and a closed end, the bag including a plurality of eyes integral with the wire mesh and spaced circumferentially about the mouth:

a slit in the wire mesh extending from the open mouth toward the closed end and adapted for receiving the electrical cable, the slit disconnecting a plurality of adjacent wire loops of the mesh;

an elongate line having opposing first and second ends, first and second line portions of the line being disposed adjacent the first and second ends respectively, an intermediate portion of the line located between the first and second line portions; and, the first portion extending through the eyes for drawing the mouth closed, and a choker fitting having an upper surface, a lower surface, a first pair of edge surfaces and a second pair of edge surfaces extending between said first pair of edge surfaces to define a surface region of said choker surfaces enclosed therebetween; said choker fitting having a first plurality of apertures extending between said upper surface and said lower surface within said surface region and said first plurality of apertures in a spaced apart array having a first of said plurality of apertures spaced a first preselected distance from a first of said first pair of edge surfaces and a second preselected distance from a first of said second pair of edge surfaces, a second of said plurality of apertures spaced said first preselected distance from said first of said first pair of edge surfaces and a third preselected distance from said first of said second pair of edge surfaces, a third of said plurality of apertures spaced said third preselected distance from said first of said second pair of edge surfaces and a fourth preselected distance from said first of said first pair of edge surfaces; said choker fitting having an end fixture spaced from said plurality of apertures and said end fixture comprising an end fixture aperture extending between said upper surface and said lower surface within said surface region, said first end of said elongate line fixed to said end fixture at said end fixture aperture.

2. The safety net assembly of claim 1 wherein the intermediate portion of the line extends through said plurality of apertures in the choker fitting so that a loop in the line protrudes from each of the upper surface and the lower surface of the choker fitting.

3. The safety net assembly of claim 2 wherein the intermediate portion of the line passes sequentially through said plurality of apertures.

4. The safety net assembly of claim 1 wherein the line further comprises a terminal eye formed on the second end of the line.

5. The safety net assembly of claim 4 wherein the assembly further comprises a hook fastener received in the terminal eye.

6. The safety net assembly of claim 1 wherein the upper surface and the lower surface of the choker fitting comprise opposing faces of a planar part of the choker fitting, the end fixture aperture having an axis disposed in the plane of the planar part of the choker fitting and a portion of the line adjacent said first end thereof passes through said end fixture aperture and the first end of the line includes a fixture thereon, whereby the first end of the line that is received in the end fixture aperture and the fixture is sized so as not to pass through the end fixture aperture.

7. The safety net assembly of claim 1 wherein the closed end of the bag opposes the open mouth and wherein a connection fixture is provided on the first portion of the line for connecting the first end of the line to the choker fitting.

8. The safety net assembly of claim 1 wherein the wire mesh bag is formed from a length of wire with fastenings joining portions of the length of wire, the length of wire extending from the closed end toward the mouth and being turned back upon itself to form the eyes at the mouth and corresponding eyes at the closed end, each eye at the mouth being fixed by a respective one of said fastenings to the adjacent eye on either side thereof, and each eye at the closed end being fixed by a respective one of said fastenings to the adjacent eye on either side thereof to form the bag.

9. The safety net assembly of claim 8 wherein the fastenings joining the eyes at the closed end are more closely spaced along the length of wire than the fastenings joining the eyes at the mouth.

10. The safety net assembly of claim 8 wherein one of the upper surface and the lower surface of the choker fitting includes a date marking located adjacent a blank area where a date can be permanently marked.

11. The safety net assembly of claim 1 wherein the wire mesh bag is formed from a rectangular main mesh panel and a pair of end panels, said plurality of eyes including first and second rows of eyes formed in opposing transverse edges of the main panel, opposing longitudinal edges of the main panel extending between the transverse edges, the end panels comprising third and fourth rows of eyes along an edge of each end panel, wherein each end panel is fixed to a respective one of the longitudinal edges of the main panel.

12. A fall arrest safety net assembly for securing an overhead fitting connected to an electrical cable, said assembly comprising:

a bag constructed of wire mesh, the bag having a closed end and an opposing open mouth, the bag includes a plurality of eyes integral with the wire mesh and spaced circumferentially about the mouth, wire mesh bag is formed from a length of wire with fastenings joining portions of the length of wire, the length of wire extending from the closed end toward the mouth and being turned back upon itself to form the eyes at the mouth and corresponding eyes at the closed end, each eye at the mouth being fixed by a respective one of said fastenings to the adjacent eye on either side thereof, and each eye at the closed end being fixed by a respective one of said fastenings to the adjacent eye on either side thereof to form the bag;

a slit in the wire mesh that is adapted for receiving an electrical cable during installation of the safety net assembly, the slit disconnecting adjacent wire loops of the mesh and extending from the open mouth toward the closed end; an elongated line having opposing first and second ends, first and second line portions of the line being disposed adjacent the first and second ends respectively, an intermediate portion of the line located between the first and second line portions, and the first portion extending through the eyes for drawing the mouth closed a choker fitting having an upper surface, a lower surface, a first pair of edge surfaces and a second pair of edge surfaces extending between said first pair of edge surfaces to define a surface region of said choker surfaces enclosed therebetween; said choker fitting having a first plurality of apertures extending between said upper surface and said lower surface within said surface region and said first plurality of apertures in a spaced apart array having a first of said plurality of apertures spaced a first preselected distance from a first of said first pair of edge surfaces and a second preselected distance from a first of said second pair of edge surfaces, a third of said plurality of apertures spaced said first preselected distance from said first of said first pair of edge surfaces and a second preselected distance from said first of said second pair of edge surfaces, a third of said plurality of apertures spaced said third preselected distance from said first of said second pair of edge surfaces and a fourth preselected distance from said first of said first pair of edge surfaces; said choker fitting having an end fixture spaced from said plurality of apertures and said end fixture comprising an end fixture aperture extending between said upper surface and said lower surface within said surface region, said first end of said elongate line fixed to said end fixture at said end fixture aperture; and the line further comprises a terminal eye formed on the second end of the line.

13. A method of securing an apparatus mounted overhead upon a construction member, the method comprising: providing a safety net assembly substantially as claimed in claim 1; introducing the apparatus through the mouth so as to at least partially enclose the apparatus in the wire mesh bag; manipulating the choker fitting and line to close the mouth; looping the second portion about the construction member, and connecting the first portion and the second end by means of a fastener.

14. A fall arrest safety net assembly for securing an overhead fitting connected to an electrical cable, said assembly comprising:

a bag constructed of wire mesh, the bag having an open mouth and a closed end, the bag including a plurality of eyes integral with the wire mesh and spaced circumferentially about the mouth;

a slit in the wire mesh extending from the open mouth toward the closed end and adapted for receiving the electrical cable, the slit disconnecting a plurality of adjacent wire loops of the mesh;

an elongate line having opposing first and second ends, first and second line portions of the line being disposed adjacent the first and second ends respectively, an intermediate portion of the line located between the first and second line portions, and, the first portion extending through the eyes for drawing the mouth closed, and a choker fitting having an upper surface, a lower surface, a first pair of edge surfaces and a second pair of edge surfaces extending between said first pair of edge surfaces to define a surface region of said choker surfaces enclosed therebetween; said choker fitting having a first plurality of apertures extending between said upper surface and said lower surface within said surface region and said first plurality of apertures in a spaced apart array having a first of said plurality of apertures spaced a first preselected distance from a first of said first pair of edge surfaces and a second preselected distance from a first of said second pair of edge surfaces, a second of said plurality of apertures spaced said first preselected distance from said first of said first pair of edge surfaces and a third preselected distance from said first of said second pair of edge surfaces, a third of said plurality of apertures spaced said third preselected distance from said first of said second pair of edge surfaces and a fourth preselected distance from said first of said first pair of edge surfaces; said choker fitting having an end fixture spaced from said plurality of apertures and said end fixture comprising an end fixture aperture extending between said upper surface and said lower surface within said surface region, said first end of said elongate line fixed to said end fixture at said end fixture aperture;

and wherein a connection fixture is provided on the first portion of the line for connecting the first end of the line to the choker fitting.

15. The fall arrest safety net assembly of claim 12 wherein a connection fixture is provided on the first portion of the line for connecting the first end of the line to the choker fitting.

* * * * *

UNITED STATES PATENT AND TRADEMARK OFFICE

CERTIFICATE OF CORRECTION

PATENT NO. : 8,714,308 B2
APPLICATION NO. : 12/460245
DATED : May 6, 2014
INVENTOR(S) : Robert Wesley Schlipper It is certified that error appears in the above-identified patent and that said Letters Patent is hereby corrected as shown below:

In the Claims,

Column 6, line 7, Claim 1, line 6, delete ":" and insert therefor --;--

Column 6, line 16, Claim 1, line 15, delete ";" and insert therefor --,--

Column 7, line 27, Claim 12, line 27, after "closed" insert therefor --; and--

Column 8, line 3, Claim 12, line 39, delete "third" and insert therefor --second--

Column 8, line 5, Claim 12, line 41, delete "second" and insert therefor --third--

Signed and Sealed this
Twenty-first Day of October, 2014

Michelle K. Lee

Michelle K. Lee
*Deputy Director of the United States Patent and Trademark Office*